US007361075B1

(12) United States Patent
Krull

(10) Patent No.: US 7,361,075 B1
(45) Date of Patent: Apr. 22, 2008

(54) HAND-HELD AMUSEMENT DEVICES AND METHODS INVOLVING SAME

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 179 days.

(21) Appl. No.: 11/256,187

(22) Filed: Oct. 21, 2005

Related U.S. Application Data

(63) Continuation-in-part of application No. 10/630,435, filed on Jul. 29, 2003, now Pat. No. 7,044,827.

(51) Int. Cl.
*A63H 33/00* (2006.01)

(52) U.S. Cl. ..... 446/491; 446/71

(58) Field of Classification Search ..... 446/71, 446/227; 472/135, 114
See application file for complete search history.

(56) References Cited

U.S. PATENT DOCUMENTS 2,999,688 A * 9/1961 Gabrielson ..... 472/25
6,419,586 B1 * 7/2002 Chiu ..... 472/25
6,461,216 B1 * 10/2002 Applewhite et al. ..... 446/219

* cited by examiner

*Primary Examiner*—Kien Nguyen

(57) ABSTRACT

A hand-held amusement device has a variety of features that encourage manipulative activities in and/or by a person's hand. These features may include various combinations of a base that is configured for rocking back and forth on a support surface; a cylinder that rotates relative to the base; a plunger that telescopes relative to the base; a clip that slides back and forth on the base; a lever that pivots back and forth on the base; a hole that extends through an end of the base to facilitate twirling of the device about a finger; at least one word embossed in braille on the base; and a spherical ball that is rotatably mounted in the base and protrudes outward from the base. The base may also be configured for rotation about as many as three orthogonal axes while supported in respective positions between a person's thumb and an opposing finger.

20 Claims, 17 Drawing Sheets

Fig. 1
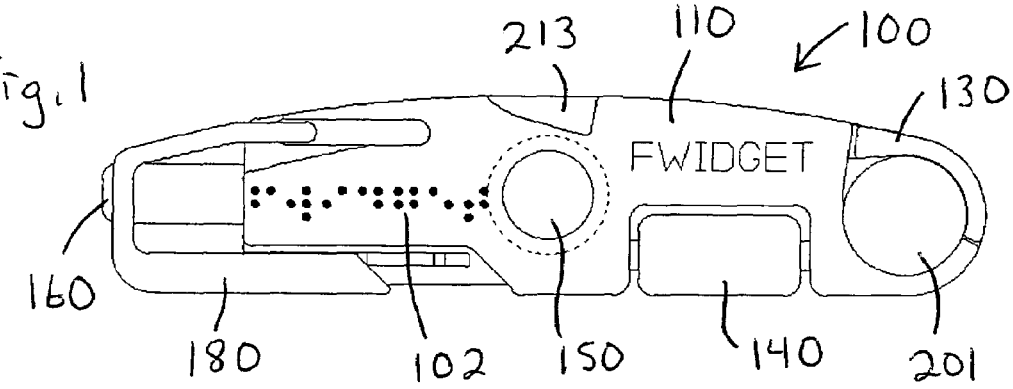
Fig. 2
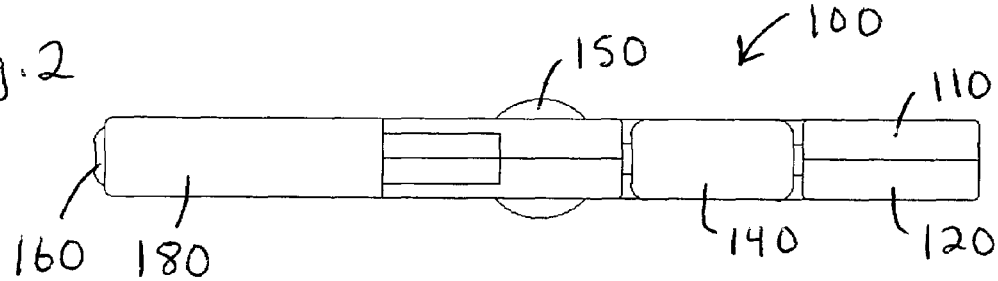
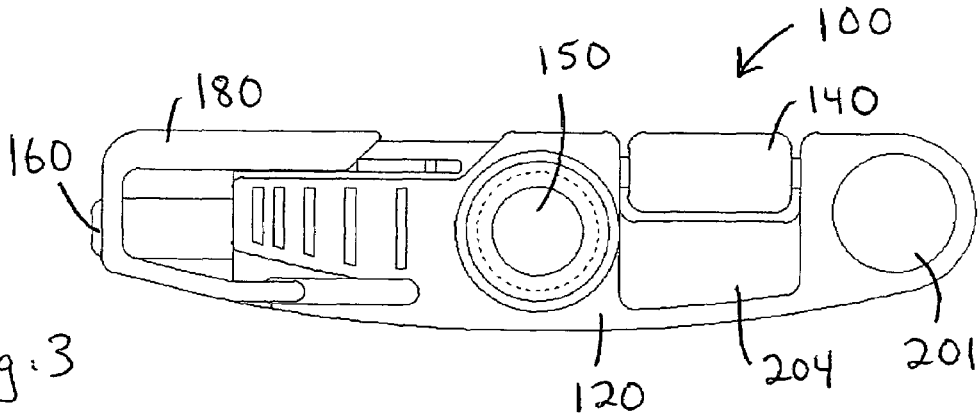
Fig. 3
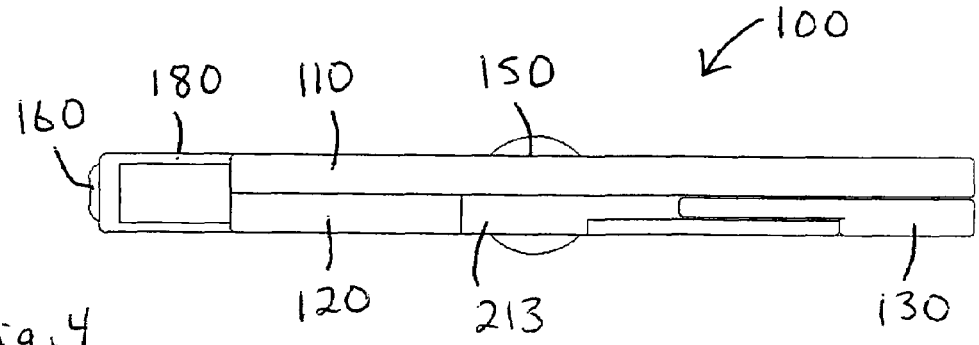
Fig. 4

Fig. 5
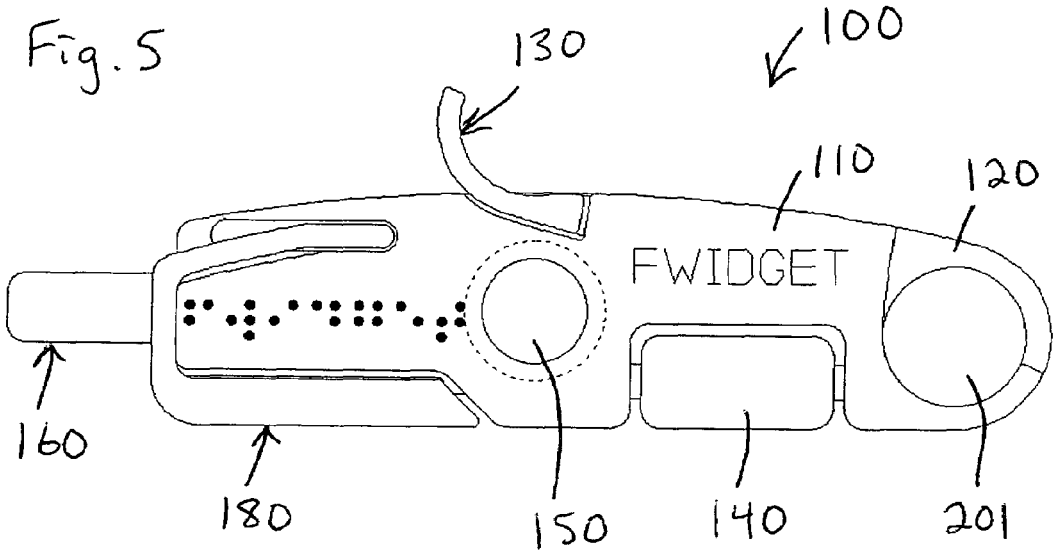
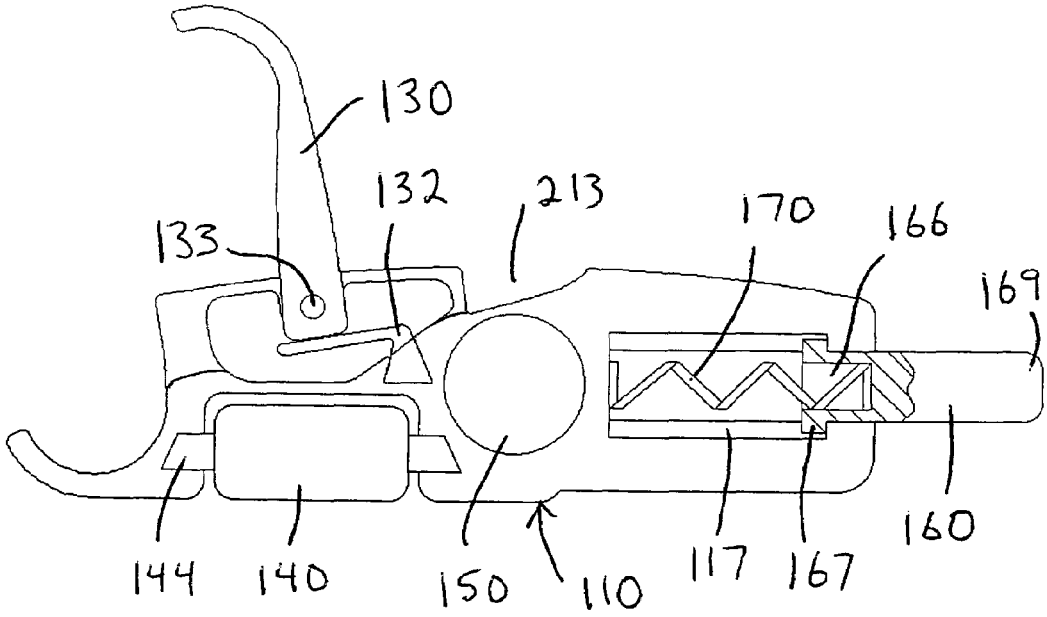
Fig. 6

Fig. 16
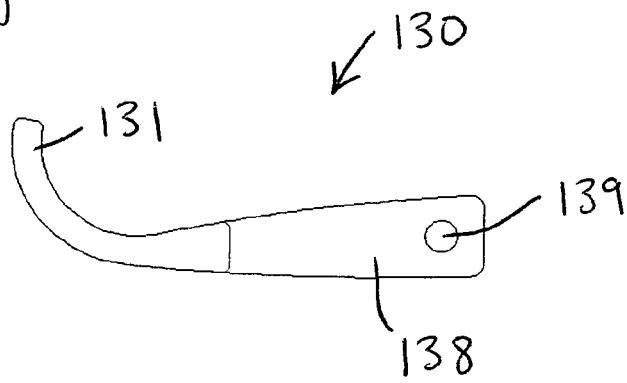
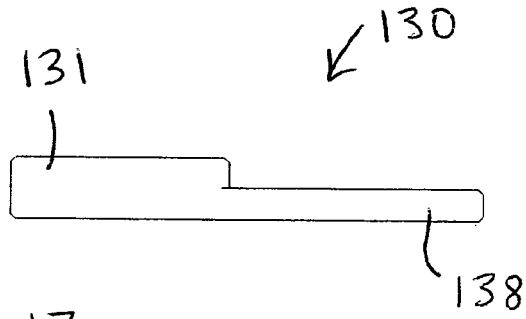
Fig. 17
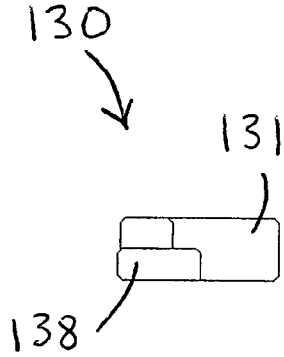
Fig. 18
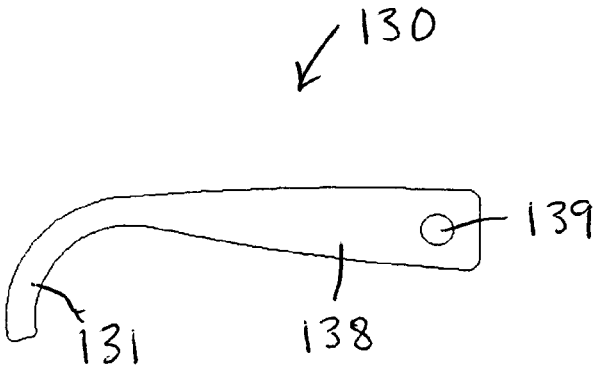
Fig. 19

Fig. 20
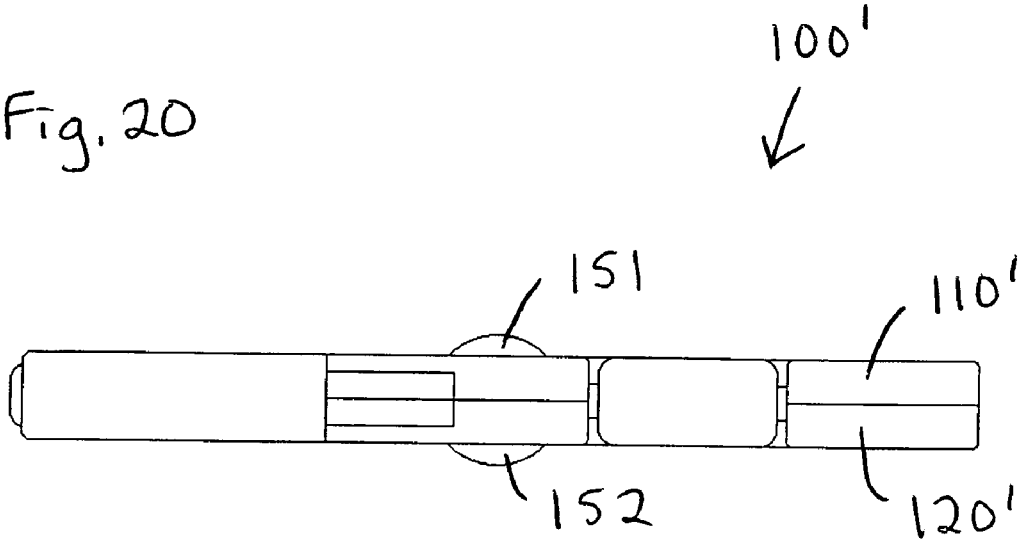
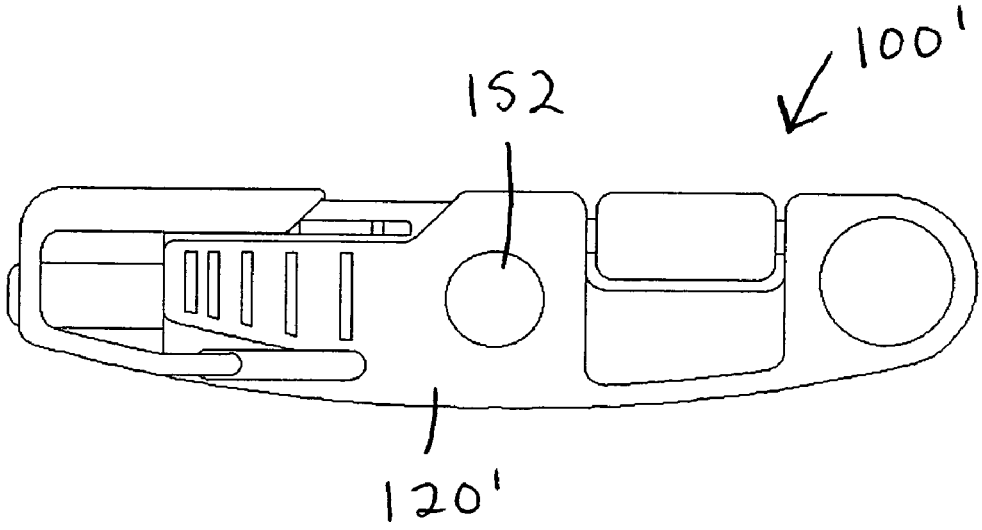
Fig. 21

Fig. 25
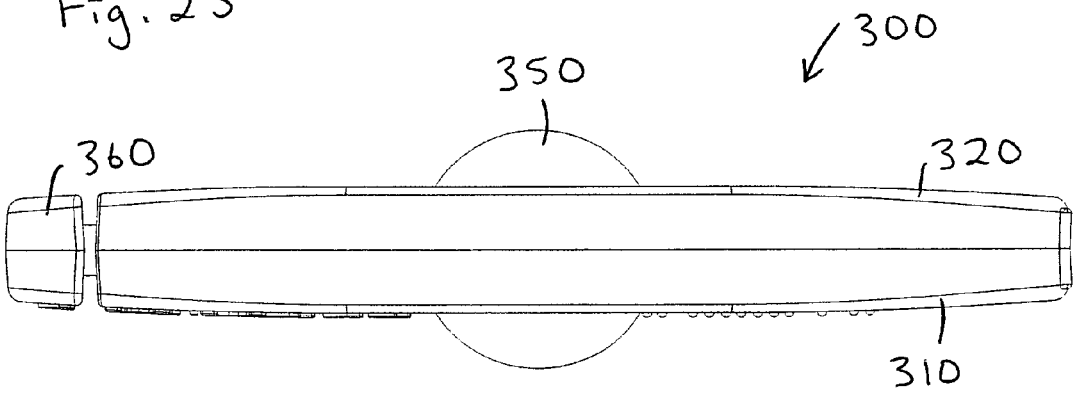
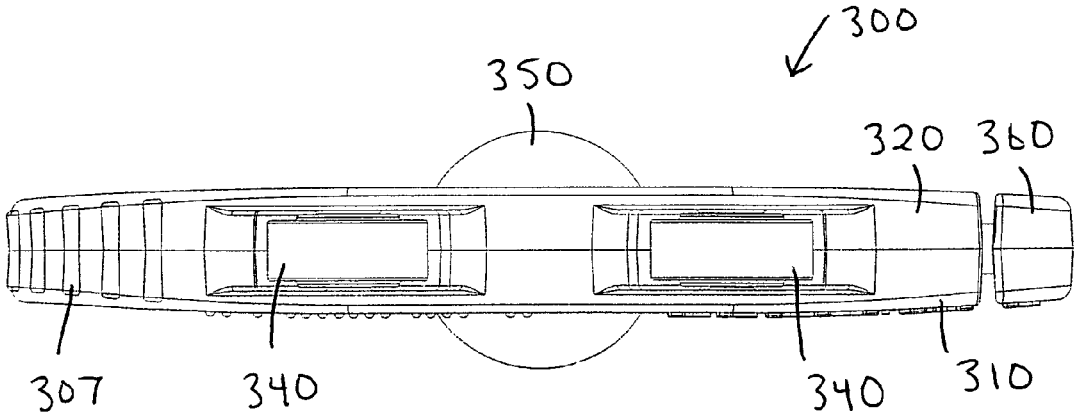
Fig. 26

HAND-HELD AMUSEMENT DEVICES AND METHODS INVOLVING SAME

CROSS-REFERENCE TO RELATED APPLICATION

This is a continuation-in-part of U.S. patent application Ser. No. 10/630,435, filed on Jul. 29, 2003 now U.S. Pat. No. 7,044,827.

FIELD OF THE INVENTION

The present invention relates to hand-held devices having various features that are designed to accommodates people's needs, desires, and/or habits to manually "fiddle" with things.

BACKGROUND OF THE INVENTION

Many people tend to perform secondary tasks while working on a primary task. Examples of such behavior include playing with a pen or pencil when writing; tapping fingers when thinking of what to type; and fiddling with whatever small objects are available when speaking on the phone. In many instances, the object associated with the secondary task is not specifically designed with the secondary task in mind. An object of the present invention is to provide devices that are designed to accommodate a variety of so-called "secondary tasks" or diversions.

SUMMARY OF THE INVENTION

The present invention may be described in terms of a hand-held amusement device having a variety of features that facilitate manipulative activities in and/or by a person's hand. These features may include various combinations of: a base that is configured for rocking back and forth on a support surface; a rotatable cylinder on the device; a telescoping plunger on the device; a sliding clip on the device; a pivoting lever on the device; a hole extending through an end of the device; at least one word embossed in braille on the device; and a spherical ball that is rotatably mounted in the device and protrudes outward from the device. Also, the device may be configured for rotation about as many as three orthogonal axes while being held in respective positions between a person's thumb and an opposing finger. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views, FIG. 1 is a top view of an amusement device constructed according to the principles of the present invention;

FIG. 2 is a side view of the amusement device of FIG. 1;

FIG. 3 is a bottom view of the amusement device of FIG. 1;

FIG. 4 is an opposite side view of the amusement device of FIG. 1;

FIG. 5 is a top view of the amusement device of FIG. 1, showing certain parts in alternative positions;

FIG. 6 is a partially sectioned bottom view of the amusement device of FIG. 1 with the second base member (of FIGS. 9-10) removed;

FIG. 16 is a top view of a lever on the amusement device of FIG. 1;

FIG. 17 is a side view of the lever of FIG. 16;

FIG. 18 is an end view of the lever of FIG. 17;

FIG. 19 is a bottom view of the lever of FIG. 16;

FIG. 20 is a side view of another amusement device constructed according to the principles of the present invention;

FIG. 21 is a bottom view of the amusement device of FIG. 20;

FIG. 25 is side view of the amusement device of FIG. 22;

FIG. 26 is an opposite side view of the amusement device of FIG. 22;

DETAILED DESCRIPTION OF A PREFERRED EMBODIMENT

An amusement device constructed according to the principles of the present invention is designated as 100 in FIGS. 1-5 (which are drawn to scale). The device 100 includes first and second base members 110 and 120 that are secured together to form a body or base sized and configured to be held in a person's hand and/or stored in a person's pocket. The members 110 and 120 are preferably injection molded plastic, and they may be secured together by adhesives, welding, fasteners, or other suitable means known in the art. Registration pegs and mating holes or other suitable means may be used to maintain the two members 110 and 120 in proper alignment with one another.

The body has a length of approximately five and one-half inches, a width of approximately one and one-quarter inches, and a thickness of approximately one-half inch. However, the dimensions may alternatively be described in terms of ranges, including a length from three inches to six inches, a width from one-half inch to one and one-half inches, and a thickness from one-half inch to one inch. Among other things, these dimensions allow the base to be spun about three orthogonal axes when held in respective positions between a person's thumb and an opposing finger. In any event, the device 100 may also be described as sized and configured to be grasped in a manner similar to hand-held objects such as hammers, tennis racquets, and utility knives, although various aspects of the present invention may be implemented in other configurations, as well.

The body of the device 100 may also be described in terms of a first side bounded by a portion of a cylindrical surface that bows or curves outward in the middle, and an opposite, second side bounded by a plane. The width of this body is measured between these two sides (along a radius of the curved surface that extends perpendicular to the straight surface). This body also has opposite top and bottom sides bounded by respective, parallel planes. The thickness of this body is measured between these parallel planes. The top side is defined by an outer surface on the first base member 110, and the bottom side is defined by an outer surface on the second base member 120.

Figure 8:
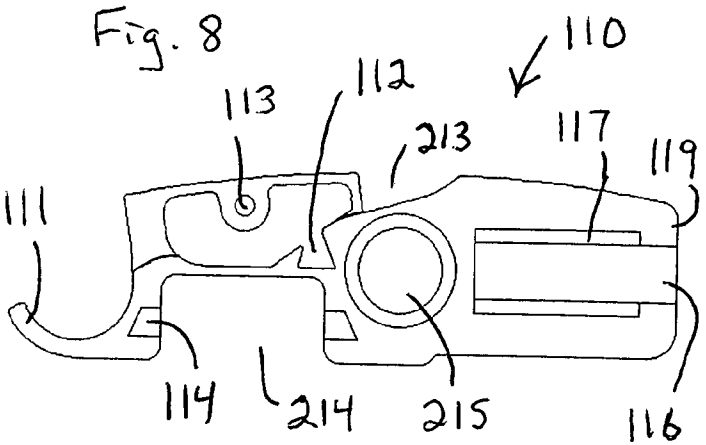
FIG. 8 is a bottom view of the first base member of FIG. 7.
Figure 7:
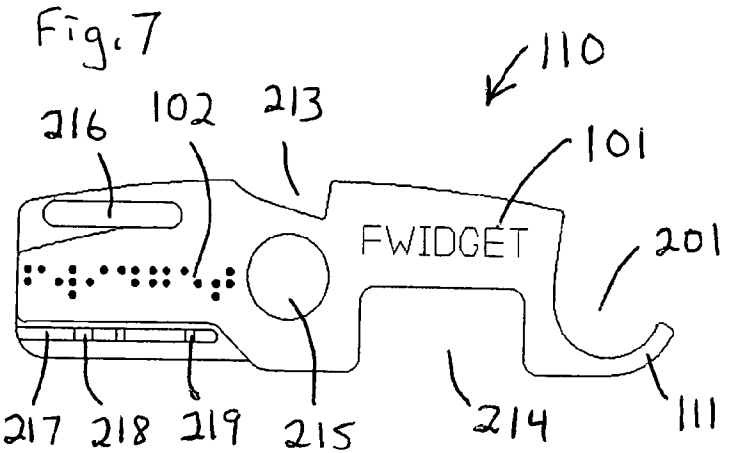
FIG. 7 is a top view of a first base member on the amusement device of Figure.

The first base member 110 is shown by itself in FIGS. 7-8. A partial spherical opening 215 is defined in the middle of the first base member 110 to accommodate a portion of a spherical ball 150, as further described below. A notch 213 extends into a first side of the first base member 110 (the same side that is described elsewhere as the first, curved side of the body) for reasons described below. The notch 213 may be described as laterally adjacent the opening 215.

In a first longitudinal direction away from the opening 215, a portion of the first base member 110 proximate the curved side is configured to accommodate a lever 130, as further described below. In this regard, the first base member 110 is notched and defines an internally accessible hole 113 to accommodate an end of a shaft 133 that is associated with the lever 130, as further described below. Also, an internally accessible cavity 112 is defined in the first base member 110 to accommodate an end of a leaf spring 132 that is also associated with the lever 130 and further described below.

At the same general longitudinal location along the first base member 110, a notch 214 extends into an opposite, second side of the first base member 110 (the same side that is described elsewhere as the second, flat side of the body) to accommodate a cylinder 140, as further described below. Grooves 114 extend into the first base member 110 at opposite ends of the notch 214 to accommodate respective ends of a shaft 144 that is associated the cylinder 140, as further described below. A first end 111 of the first base member 110, disposed in the same first longitudinal direction away from the opening 215, is configured as a hook that bounds part of a circular opening 201, as further described below.

In an opposite, second longitudinal direction away from the opening 215, an internally accessible channel 116 extends longitudinally from a closed, inner end that is proximate the opening 215, to an open, outer end that terminates together with the opposite, second end 119 of the first base member 110. First and second internally accessible grooves 117 extend along opposite sides of the channel 116 but terminate short of the second end 119 of the first base member 110. The grooves 117 and the channel 116 accommodate respective portions of a plunger 160, as further described below.

In the same, second longitudinal direction away from the opening 215, the external side of the base member 110 is configured to accommodate a clip 180, as further described below. In this regard, portions of both base members 110 and 120 are configured to define rails that are straddled by respective portions of the clip 180. An externally accessible channel 216 extends longitudinally along the top of the base member 110, proximate the curved side, to accommodate part of the clip 180. An externally accessible groove 217 extends longitudinally along the top of the base member 110, proximate the straight side, to accommodate another part of the clip 180. A stop 218 spans the groove 217 to prevent unintentional removal of the clip 180 from the base, and bumps 219 span the groove 217 to define latched positions for the clip 180 relative to the base.

The top side of the base member 110 includes room for information or texturing (e.g. the FWIDGET logo 101) in a region overlying the leaf spring 132, and room for information or texturing (e.g. FWIDGET embossed in braille 102) in a region overlying the plunger channel 116. These same regions provide bearing surfaces on which you can place your fingers in a manner that straddles the ball 150 (for reasons described below). In other words, these regions may be described in terms of respective first and second upwardly bearing surfaces disposed on opposite sides of the ball, each of which extends parallel to the length of the base member 110 for a distance at least as great as the diameter of the ball 150.

Figure 10:
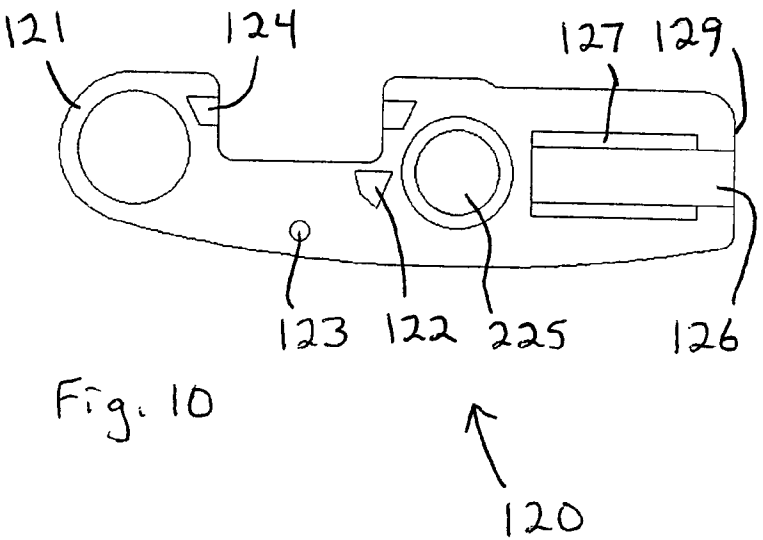
FIG. 10 is a top view of the second base member of FIG. 9.
Figure 9:
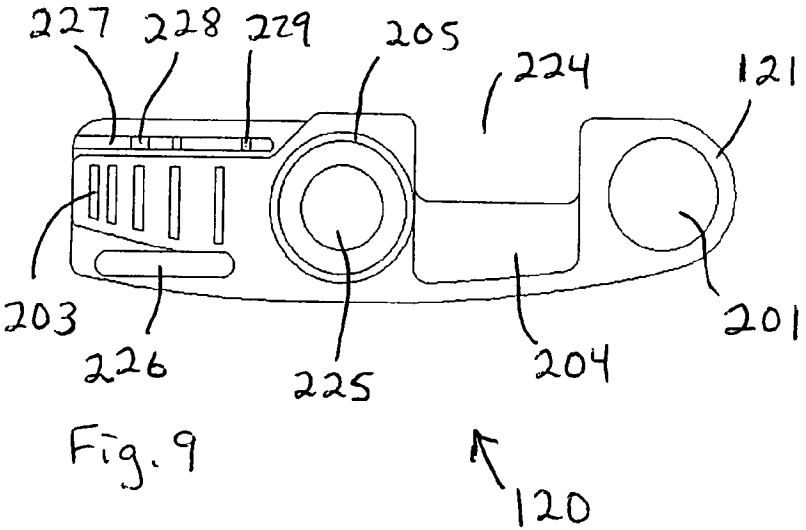
FIG. 9 is a bottom view of a second base member on the amusement device of FIG. 1.
Figure 14:
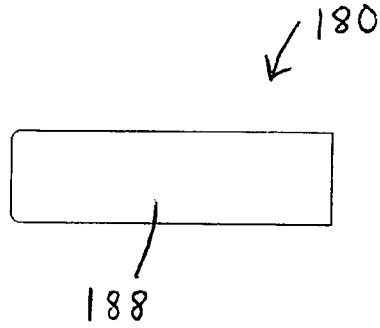
FIG. 14 is a side view of the clip of FIG. 11.
Figure 12:
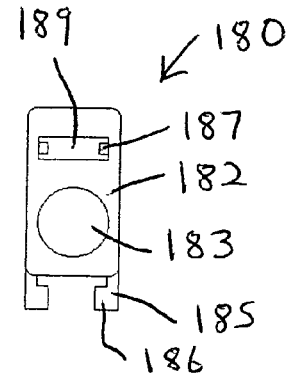
FIG. 12 is an end view of the clip of FIG. 11.
Figure 11:
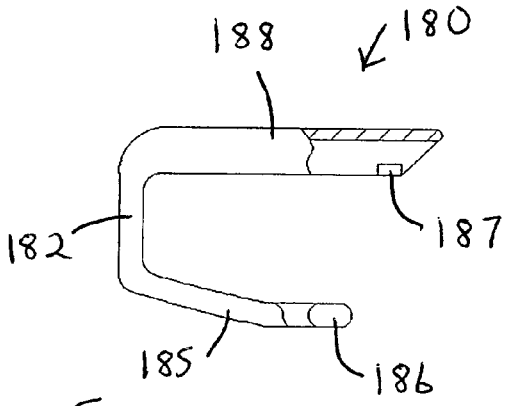
FIG. 11 is a partially sectioned top view of a clip on the amusement device of FIG. 1.
Figure 13:
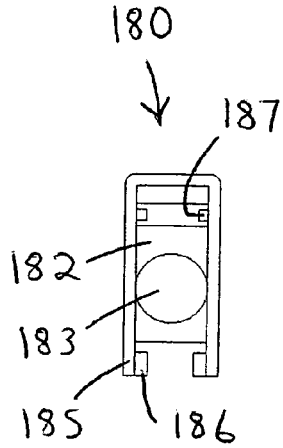
FIG. 13 is an opposite end view of the clip of FIG. 11.
Figure 15:
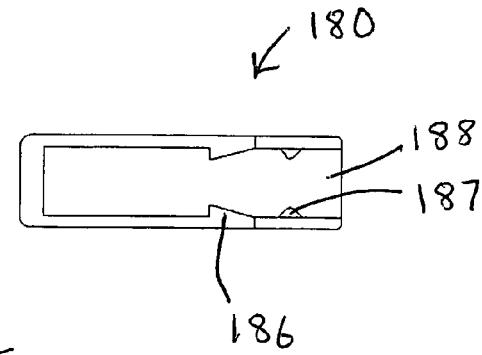
FIG. 15 is an opposite side view of the clip of FIG. 11.
Figure 22:
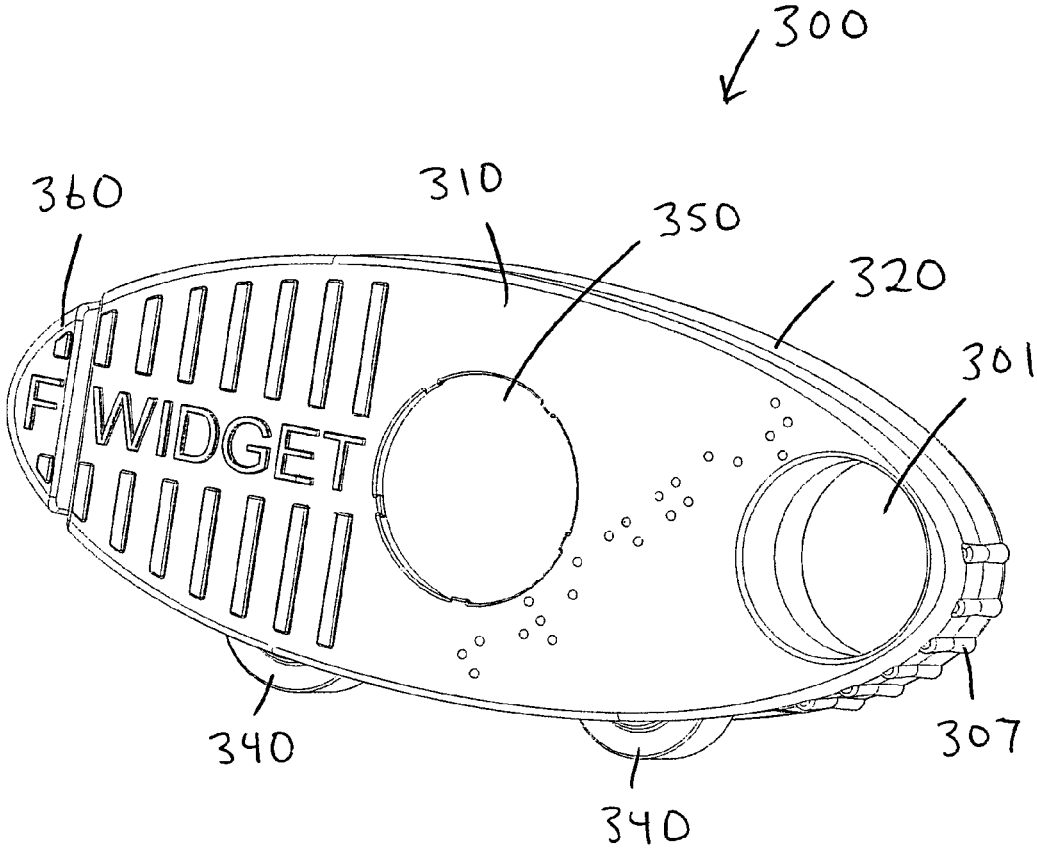
FIG. 22 is a perspective view of yet another amusement device constructed according to the principles of the present invention.
Figure 23:
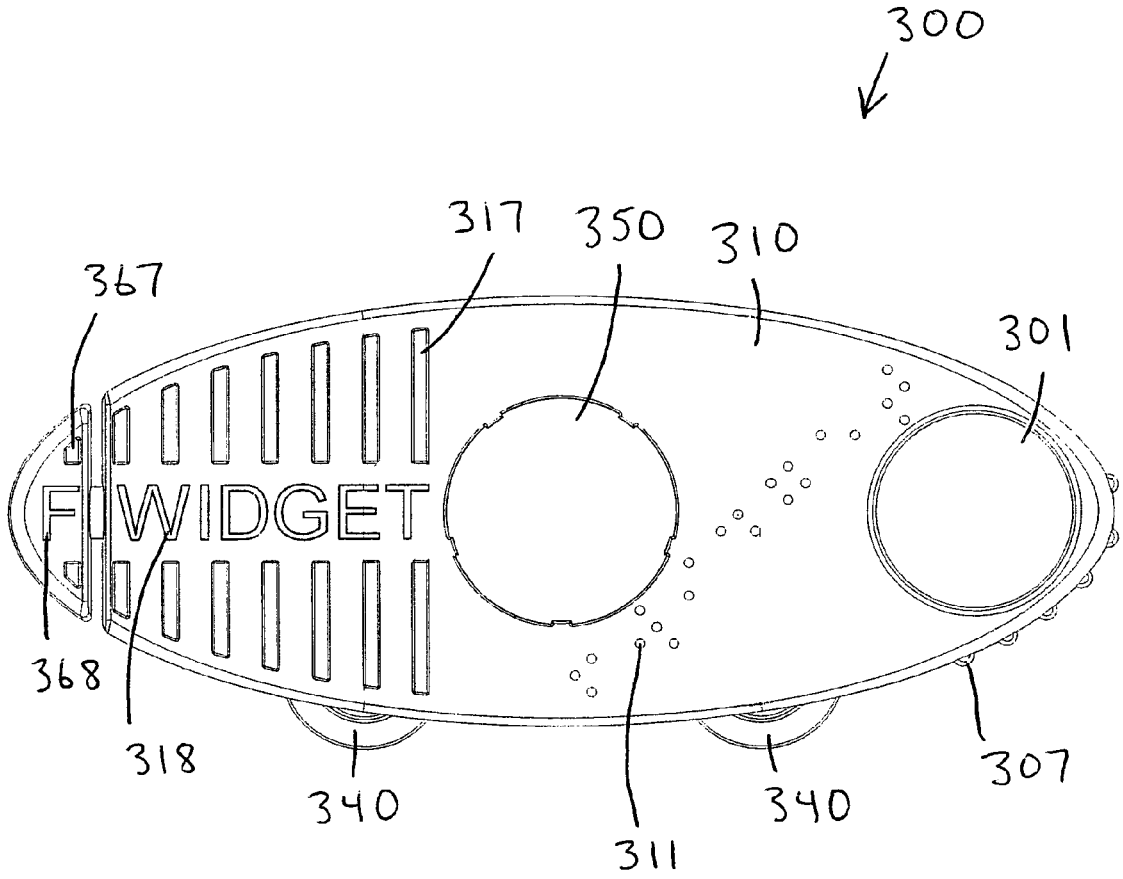
FIG. 23 is a top view of the amusement device of FIG. 22.
Figure 24:
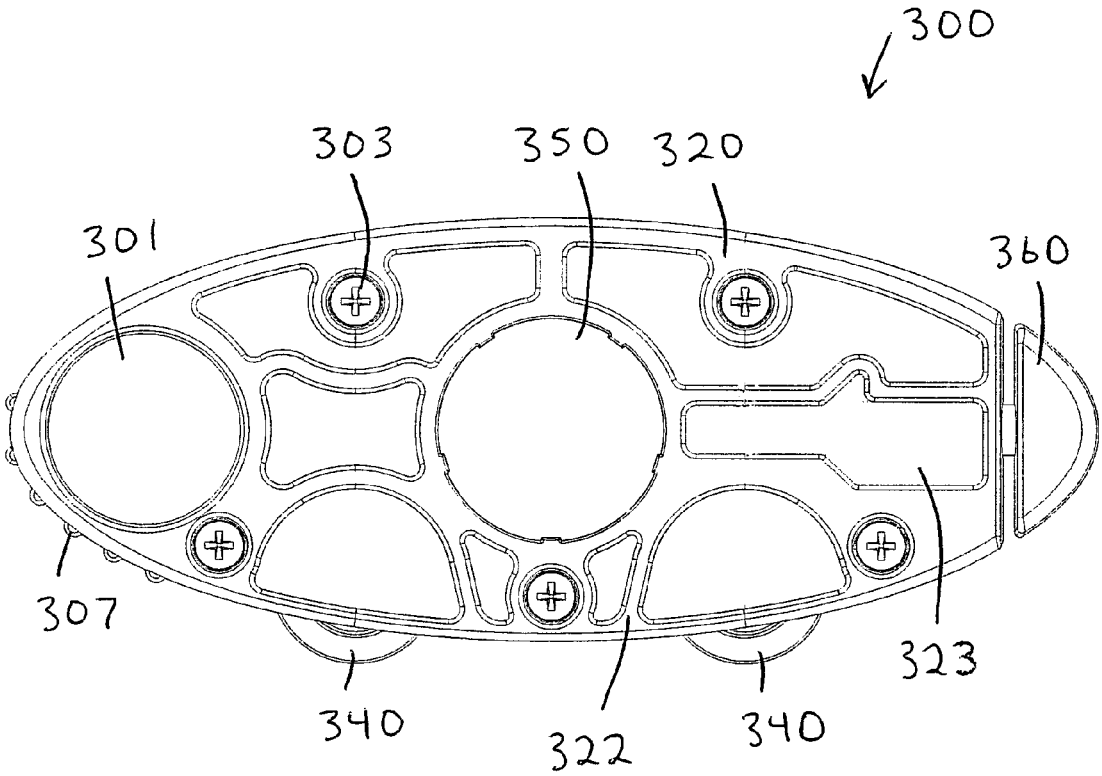
FIG. 24 is a bottom view of the amusement device of FIG. 22.

The second base member 120 is shown by itself in FIGS. 9-10. A partial spherical opening 225 is defined in the middle of the second base member 120 to accommodate a portion of the spherical ball 150. In a first longitudinal direction away from the opening 225, the second base member 120 defines an internally accessible hole 123 to accommodate an opposite end of same shaft 133. Also, an internally accessible cavity 122 is defined in the second base member 120 to accommodate an end of the leaf spring 132.

At the same general longitudinal location along the second base member 120, a notch 224 extends into an opposite, second side of the second base member 120 (the same side that is described elsewhere as the second, flat side of the body) to accommodate the cylinder 140. Grooves 124 extend into the second base member 120 at opposite ends of the notch 224 to accommodate respective ends of the shaft 144. A first end 121 of the second base member 120, disposed in the same first longitudinal direction away from the opening 225, is configured as a closed loop that bounds the circular opening 201.

In an opposite, second longitudinal direction away from the opening 225, an internally accessible channel 126 extends longitudinally from a closed, inner end that is proximate the opening 225, to an open, outer end that terminates together with the opposite, second end 129 of the second base member 120. First and second internally accessible grooves 127 extend along opposite sides of the channel 126 but terminate short of the second end 129 of the second base member 120. The grooves 127 and the channel 126 accommodate respective portions of the plunger 160.

In the same, second longitudinal direction away from the opening 225, the external side of the base member 120 is configured to accommodate the clip 180. As noted above, portions of the base members 110 and 120 are configured to define rails that are straddled by respective portions of the clip 180. An externally accessible channel 226 extends longitudinally along the top of the base member 110, proximate the curved side, to accommodate part of the clip 180. An externally accessible groove 227 extends longitudinally along the top of the base member 110, proximate the straight side, to accommodate another part of the clip 180. A stop 228 spans the groove 227 to prevent unintentional removal of the clip 180 from the base, and bumps 229 span the groove 227 to define latched positions for the clip 180 relative to the base.

The top side of the base member 120 includes a recessed area 204 in a region overlying the leaf spring 132, and aligned with the notch 224. This recessed area 204 increases accessibility to the cylinder 140. The top side of the base member 120 also includes room for information or texturing (e.g. ridges 203 spaced apart from one another by distances that grow progressively larger) in a region overlying the plunger channel 126, and room for information or texturing (e.g. the circular ridge 205) in a region surrounding the opening 225.

FIGS. 16-19 show the lever 130 by itself. The lever 130 may be described as a hook-shaped member having a base end 138 that is approximately one-half as thick as the first base member 110, and a hooked end 131 that is approximately equal in thickness to the first base member 110. A hole 139 extends through the base end 138 to receive the shaft 133 (which is preferably a steel pin). On an alternative embodiment, the shaft 133 and the lever 130 are formed as a single integral part.

FIG. 6 shows how the lever 130 and the leaf spring 132 are positioned relative to the first base member 110. The hole 139 in the lever 130 is aligned with the hole 113 in the base member 110, and the hooked end 131 of the lever 130 is arranged to oppose the hooked end 111 of the base member 110. The leaf spring 132 has a relatively thicker, trapezoidal base that projects into the cavity 112 in the base member 110, and that projects into the similar cavity 122 in the base member 120, as well. The opposite, distal end of the leaf spring 132 bears against the base end 138 of the lever 130. The leaf spring 132 bears against respective bearing surfaces on the lever 130 to bias the lever 130 to remain in one of three orientations (shown in FIGS. 1, 5, and 6). The spring 132 may be described as a means for biasing the lever to remain in any of these orientations and/or resisting movement of the lever from these orientations.

FIG. 6 also shows how the cylinder 140 and the shaft 144 are positioned relative to the first base member 110. A hole extends lengthwise through the cylinder 140 to rotatably receive the shaft 144 (which is preferably a steel pin). As with the lever 130 and the shaft 133, the cylinder 140 and the shaft 144 are formed as a single integral part on an alternative embodiment (in which case the ends of the "shaft" are cut straight across to eliminate any impediment to rotation relative to the base). On the device 100, the ends of the shaft 144 are beveled to match the shape of the grooves 114 and 124 in respective base members 110 and 120.

FIG. 6 also shows how the spherical ball 150 is positioned relative to the first base member 110. The ball 150 is preferably made of steel and sized and configured to be retained between the base members 110 and 120, while remaining free to rotate relative thereto and protruding outward therefrom. Alternative embodiment balls may be made of plastic, glass, ceramic, or other suitable material.

FIG. 6 also shows how the plunger 160 and an associated coil spring 170 are positioned relative to the first base member 110. The plunger 160 is preferably an injection molded, tubular member having a rounded, closed end 169 that protrudes outward beyond the base, and an opposite, open end disposed inside the base. Tabs 167 extend outward from diametrically opposed portions of the plunger 160, proximate its interior end, and travel along respective channels 117 and 217 in the base members 110 and 120. The tabs 167 prevent removal of the plunger 160 from the fully assembled base. A bore 166 extends into the open end of the plunger 160, and the spring 170 is compressed between the end wall of the bore 166 and the interior end walls of the channels 116 and 126. The spring 170 may be described as a means for biasing the plunger 160 outward, and/or resisting inward movement of the plunger 160. The bore 166 may be made relatively deeper into the plunger 160 to receive a ballast weight if deemed necessary to help make the center of mass of the device 100 coincidental with the center of the ball 150.

The device 100 is assembled by arranging the parts shown in FIG. 6 in the manner shown in FIG. 6; aligning the second base member 120 relative thereto; and securing the second base member 120 to the first base member 110. The clip 180 is then forced onto the base until it snaps into engagement with the grooves 216-217 and 226-227 as further explained below.

FIGS. 11-15 show the clip 180 by itself. The clip 180 may be described as a generally U-shaped member that is preferably injection molded plastic. A central portion 182 of the clip 180 spans part of the second ends 119 and 219 of respective base members 110 and 120, and defines a hole 183 that is configured to accommodate passage of the protruding end of the plunger 160. Opposing legs 185 extend away from a first end of the central portion 182, and tabs 186 on the distal ends of the legs 185 snap into respective grooves 216 and 226. A U-shaped leg 188 extends away from an opposite, second end of the central portion 182, and opposing nubs 187 on the distal end of the leg 188 snap into respective grooves 217 and 227. A window 189 extends through the central portion 182 to facilitate formation of the nubs 187 by injection molding. The tabs 186 and the nubs 187 prevent unintentional removal of the cap 180 from the base, and the nubs 187 may also be described as means for biasing the cap 180 to remain in either of the positions shown in FIGS. 3 and 5, and/or for resisting movement of the cap 180 from either of these positions.

When the cap 180 occupies the position shown in FIG. 3, the plunger 160 is substantially covered, and the legs 185 effectively extend the curved side of the base, thereby facilitating rocking the device 100 back and forth on a support surface. The cap 180 may also serve as a source of amusement by sliding back and forth along the base, and/or clicking into and out of latched positions relative to the base.

When the cap 180 occupies the position shown in FIG. 5, substantially more of the plunger 160 is exposed and available for interaction with a user. One way to use the plunger 160 for amusement purposes is to push it inward with your thumb while holding the base in your hand. Another option is to position the plunger 160 against a support surface, and push down on the device 100. Yet another possibility is to position the plunger 160 proximate a support surface and let the device 100 "bounce" against the support surface.

The ball 150 facilitates multiple amusement activities, as well. For example, you can use a thumb or finger to rotate the ball 150 while holding the device 100 in your hand. You can also hold the ball 150 between your thumb and an opposing finger, and spin the base relative to the ball 150. Yet another available option is to place the ball 150 on a support surface; place your fingers on the base in a manner that straddles the ball 150 (with respective fingers bearing on regions overlying the leaf spring 132 and the plunger channel 116, respectively); and roll or "surf" the device 100 across the support surface. Alternatively, when the ball 150 is on the support surface, you can place a finger on the ball 150, and spin the base about the ball 150.

The cylinder 140 may be rotated by a thumb or finger when the device 100 is being held in your hand. Also, the cylinder 140 may be rolled against a support surface or the edge of a support surface. Moreover, depending on the embodiment, the cylinder 140 may be moved axially back and forth between the end walls of the notches 214 and 224.

The lever 130 may be pivoted by a thumb or finger when the device 100 is being held in your hand. The lever 130 may be pivoted from the position shown in FIG. 6, toward the position shown in FIG. 1 to "pinch" a finger or other object between the hooked end 131 and the first end 121 of the base member 120. Also, when the lever 130 is moved to the position shown in FIG. 5, the hooked end 131 is configured to "hang" on a finger or thumb. Alternatively, the protruding hooked end 131 may be positioned on a support surface to facilitate spinning of the device 100 relative to the support surface (when a finger is positioned on a diametrically opposite portion of the base), or the device 100 may be spun while holding the opposite curved and straight sides of the base between your thumb and an opposing finger.

The opening 201 accommodates still more amusing activities. For example, you can stick a finger through the hole 201 and "twirl" the device 100 about your finger. Alternatively, you can stick a pencil (or rubber band) through the hole 201; grab the opposite ends of the pencil (or rubber band) in opposite hands; and "whirl" the device 100 about the pencil or (rubber band).

Additional amusement features are integrated into the base itself. For example, the braille letters 102 and the ridges 203 and 204 provide interesting textures to rub your thumb or fingers across. Also, the base is sized and configured so that you can hold the device 100 lengthwise between your thumb and an opposing finger, and spin the device 100 about its longitudinal axis.

FIGS. 20-21 show an alternative embodiment amusement device 100' constructed according to the principles of the present invention. The device 100' is similar to the device 100, except that the ball 150 has been replaced by similarly configured domes 151 and 152 that are integral portions of respective base members 110' and 120'. This alternative to the ball 150 allows the device 100' to be balanced, wobbled, and/or spun on an underlying support surface, but not rolled or surfed across the surface.

Another amusement device constructed according to the principles of the present invention is designated as 300 in FIGS. 22-28 (which are drawn to scale). The device 300 includes first and second base members 310 and 320 that are secured together to form a body or base which is sized and configured to be held in a person's hand and/or stored in a person's pocket. The members 310 and 320 are preferably injection molded plastic, and they are secured together by screws 303 (which are threaded into the base member 310 and countersunk relative to the base member 320). Registration pegs and holes, overlapping ridges, and/or other suitable means may be used to maintain the two members 310 and 320 in proper alignment with one another.

The resulting body has a length of approximately three and three-quarters inches, a width of approximately one and five-eighths inches, and a thickness of approximately one-half inch. However, the dimensions may alternatively be described in terms of ranges and/or limits, including a length of less than six inches, a width of less than two inches, and a thickness of less than two inches. Among other things, these dimensions allow the base to be spun about at least two different, orthogonal axes when held in respective positions between a person's thumb and an opposing finger.

The base of the device 300 may also be described in terms of an elliptical profile that is clipped at one end. The profile of the ellipse is bounded on opposite sides bounded by respective top and bottom surfaces (which are defined by respective base members 310 and 320). The thickness of the base is measured between these two surfaces.

In many respects, the two base members 310 and 320 are mirror images of each other. For example, each member 310 and 320 has an internal, partial spherical opening that is concentrically aligned with the center of the elliptical profile. These two openings cooperate to accommodate and retain a spherical ball 350 in such a manner that the ball 350 is rotatable relative to the base, and diametrically opposed portions of the ball 350 project outward from opposite sides of the base. Five circumferentially spaced ribs are disposed about the openings to reduce the amount of material in contact with the ball 150. On this embodiment 300, the ball 350 has a diameter of fifteen-sixteenths of an inch and is made of stainless steel, but may alternatively be provided in other sizes and/or other materials, including glass, plastic, or ceramic.

Figure 29:
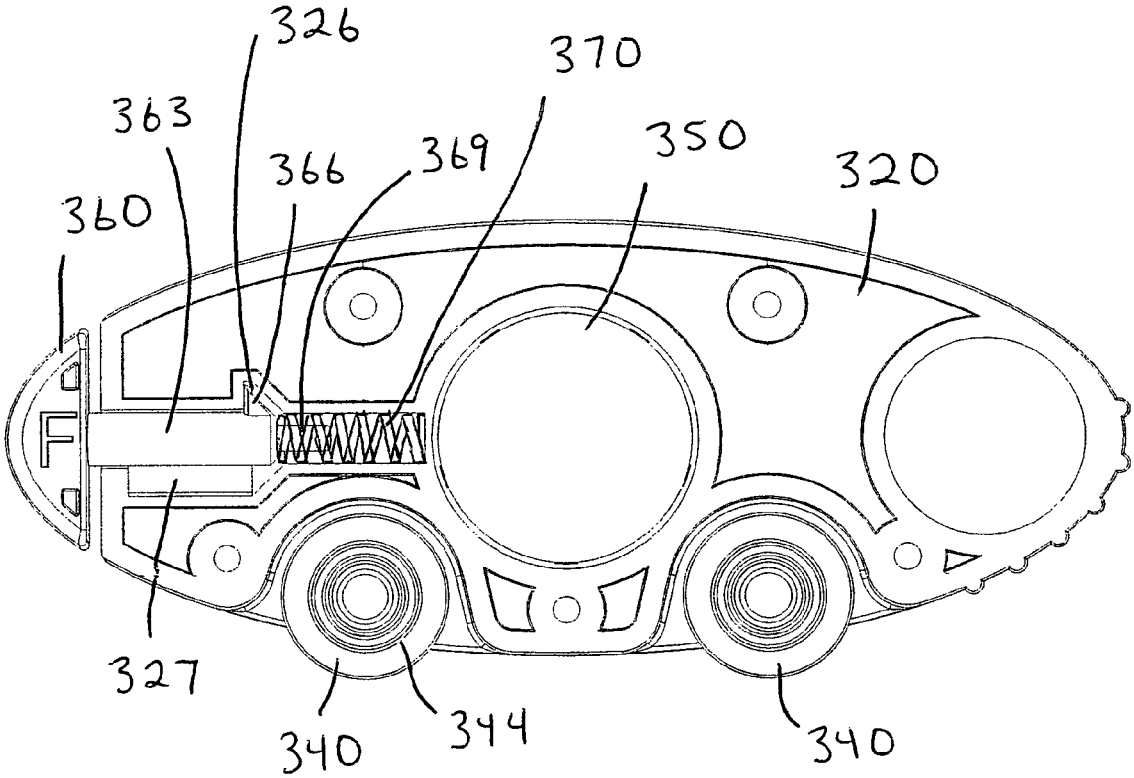
FIG. 29 is a top view of certain components of the amusement device of FIG. 22.

Each member 310 and 320 also has an internal channel proximate the clipped end of the elliptical profile (one of the grooves is shown in FIG. 29 with reference to the base member 320). As further described below, these two grooves cooperate to accommodate a stem portion 363 of a plunger 360 in such a manner that the plunger 360 is movable between a retracted position and an extended position relative to the base, and rotatable between a latched position and an unlatched position when in its retracted position. The plunger 360 is preferably an injection molded plastic part, and it is sized and configured to complete the "missing end" of the clipped elliptical profile defined by the base members 310 and 320 (when occupying its retracted position relative thereto). In other words, the plunger 360 cooperates with the base members 310 and 320 to define an elliptical assembly having an elliptical profile that is approximately four and one-eighth inches in length, approximately one and five-eighths inches in width, and having a thickness of approximately one-half inch.

An unobstructed hole 301 extends through each member 310 and 320 proximate an end opposite the plunger 360. The term "unobstructed" is intended to distinguish the hole 301 from holes like those that receive the screws 303, for example. With an inside diameter of approximately three-fourths of an inch, the hole 301 is sized and configured to receive at least the end of a pencil, and preferably the end of a person's index finger, as well.

Each member 310 and 320 also has first and second wheel wells or cavities disposed along one of the two long sides of the elliptical profile, as well as cooperating hub members that extend across respective wheel wells. First and second wheels 340 are rotatably mounted on respective hub members and protrude outward beyond the elliptical profile. FIG. 29 shows the wheels 340 in their entirety, as well as their location relative to the hub members and wheel wells on the base member 320. The wheels 340 are preferably injection molded plastic parts that are cylindrical in shape, and that have an outside diameter of approximately two-thirds of an inch. Rings 344 are embossed on the sides of the wheels 340 to reduce the amount of contact between the wheels 340 and the wheel well walls on the base members 310 and 320.

Figure 27:
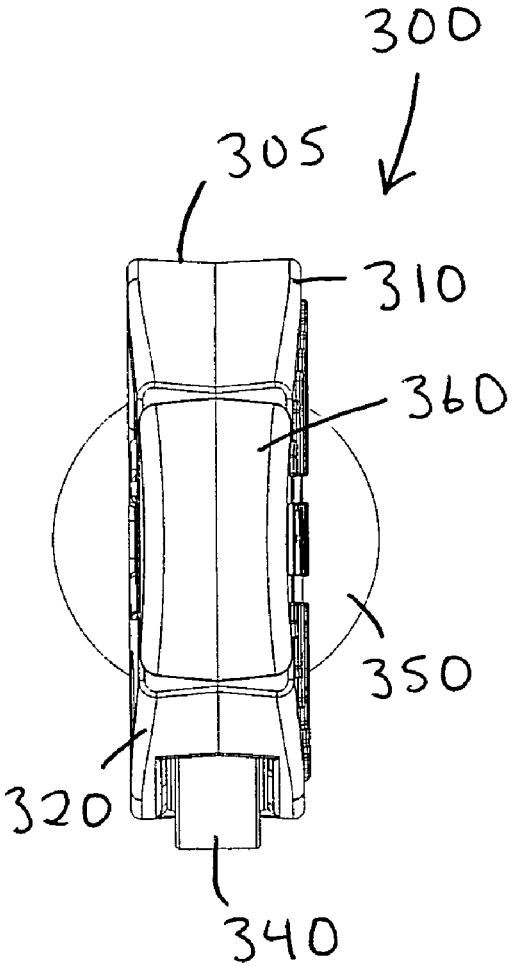
FIG. 27 is an end view of the amusement device of FIG. 22.
Figure 28:
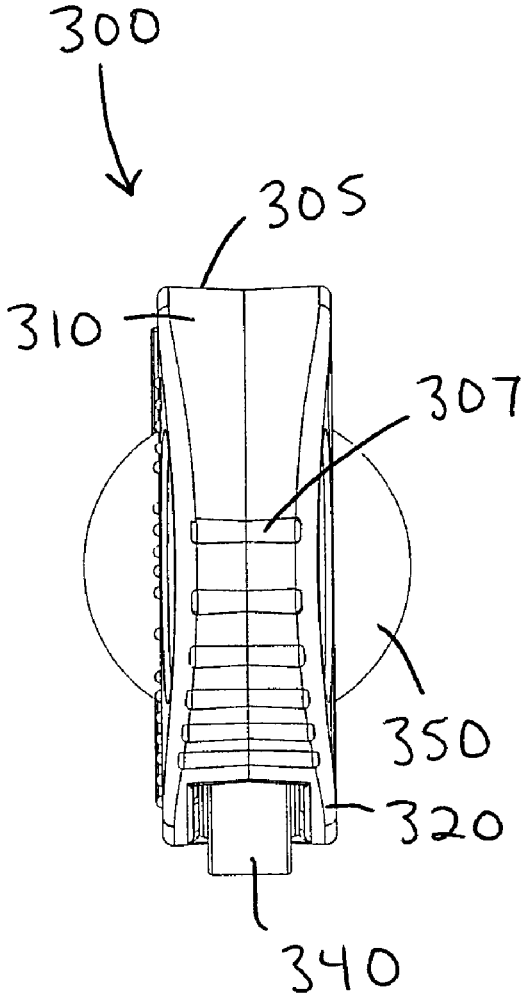
FIG. 28 is an opposite end view of the amusement device of FIG. 22.
Figure 31:
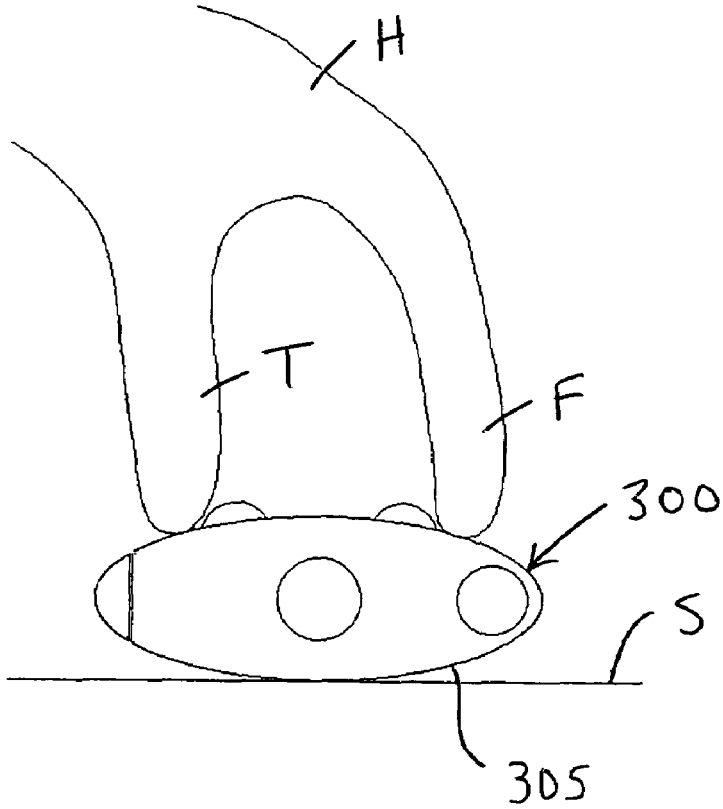
FIG. 31 is a diagrammatic view of the amusement device of FIG. 22 being rocked back and forth on an underlying support surface.

On each member 310 and 320, the other long side of the elliptical profile (opposite the wheels 340) may be described as an uninterrupted curved side (designated as 305 in FIGS. 27-28 and 31). As shown in FIGS. 27 and 28, the members 310 and 320 are formed in such a manner that this curved side 305 has a concave middle portion that extends between outermost edges on respective members 310 and 320. As a result, the device 300 may be balanced on its side 305 relative to a flat surface.

Circumferentially spaced ribs 307 are embossed along the side of each member 310 and 320 proximate the hole 301. These ribs 307 extend perpendicular to the elliptical profile (and parallel to the thickness of the base). Like the curved side 305 described in the preceding paragraph, these ribs 307 are formed in such a manner that each has a concave middle portion that extends between outermost edges on respective members 310 and 320.

Certain additional features are embossed on the top or outer surface of the base member 310. One such feature is a braille representation 311 of the term or trademark FWIDGET, which extends between the hole 301 and the ball 350. Also, the term WIDGET (designated as 318) is embossed in common letters on the top surface between the plunger 360 and the ball 350. Furthermore, parallel ridges 317 are embossed on the top surface above and below the term WIDGET. In addition to contributing to the overall look of the device 300, these features also function as additional sources of amusement from the perspective of tactile stimulation.

Certain complementary features are embossed on the top surface of the plunger 360. In this regard, the letter F (designated as 368) is embossed on the plunger 360 in a manner that changes the term WIDGET into the term FWIDGET when the plunger 360 is latched in its retracted position relative to the base (as further explained below). Similarly, ridges 367 are embossed on the plunger 360 above and below the letter F. In addition to providing the functions described above with reference to the embossed features on the base member 310, these plunger features 367 and 368 cooperate with respective base features 317 and 318 to provide visual confirmation when the plunger 360 is latched in its retracted position relative to the base. In this regard, the letter F and the ridges 367 and the term WIDGET and the ridges 317 constitute complementary or visually related terms and/or symbols when the plunger 360 is latched in place.

Certain distinct features are embossed on the bottom or outer surface of the base member 320. In this regard, an interconnected ridge pattern 322 is embossed on the bottom surface of the base member 320. In addition to providing the functions described above with reference to the embossed features on the base member 310 and the plunger 360, this pattern 322 defines a depression 323 that provides a visual suggestion regarding operation of the plunger 360 relative to the base (as further described below).

FIG. 29 shows the device 100 except for the base member 310, thereby providing an interior view of the base member 320, and an unobstructed view of the wheels 340, the ball 350, the plunger 360, and a spring 370 associated with the plunger 360. The plunger 360 includes a head portion, which bears the letter F and the ridges 367, a stem portion 363, which telescopes relative to the base, a hook portion 366, which projects radially outward from an end of the stem portion 363 opposite the head portion, and a peg 369 that projects axially outward from the distal end of the stem portion 363. The spring 370 is a compressed, helical coil spring having a first end that fits onto the peg 369 and bears against the distal end of the stem portion 363, and an opposite, second end that bears against a wall defined by the base members 310 and 320 between the spring 370 and the ball 350.

When the plunger 360 is arranged as shown in FIG. 29, the hook portion 366 is biased to remain in a notch 326 defined by the base members 310 and 320. When the plunger 360 is rotated one hundred and eighty degrees about its longitudinal axis (which extends through the stem portion 363, the spring 370, and the center of the ball 350), the hook portion 366 enters a groove 327 defined by the base members 310 and 320, and moves along the groove 327 in a direction away from the ball 350 (in the absence of externally applied forces). In other words, the plunger 360 and the spring 370 are disposed inside an opening in the base that is similar in configuration to the depression 326 in the bottom surface of the base member 320. When the plunger 360 is unlatched relative to the base, the letter F on the plunger 360 faces in an opposite direction relative to the term WIDGET on the base, and the plunger 360 is not rotatable relative to the base.

Among other things the devices 100, 100', and 300 may be described in terms of a hand-held amusement device, comprising a base having a length that is less than six inches, a width that is less than two inches, and a thickness that is less than the width; and a spherical ball rotatably mounted inside the base and projecting outward from opposite sides thereof, whereby a person can hold diametrically opposed portions of the ball between a finger and opposing thumb and spin the base through multiple revolutions relative to the ball.

Such a device may be further described in terms of: (a) a base including bearing surfaces disposed on opposite sides of the ball, whereby a person can place at least one digit on each of the bearing surfaces and roll the device across an underlying support surface while maintaining the base entirely out of contact with the support surface; (b) the base having an elliptical profile, wherein the thickness is measured perpendicular to the elliptical profile, whereby a person can position the device on an underlying support surface with the thickness and the length extending parallel to the support surface, and rock the device back and forth on the support surface; (c) a plunger telescopically mounted on an end of the base, whereby a person can move the plunger relative to the base; (d) a hole extending through an opposite end of the base, whereby a person can insert a finger into the hole and spin the device about the finger; (e) the plunger bearing at least one symbol that is complementary to at least one other symbol disposed on the base; (f) the symbol on the plunger being visually associated with the symbol on the base when the plunger occupies a first position relative to the base, and the symbol on the plunger being visually separated from the symbol on the base when the member occupies a second position relative to the base; and/or (g) at least one term embossed in braille on the base.

The present invention may alternatively be described in terms of a hand-held amusement device, comprising: a base, wherein the base has a curved peripheral edge that is configured and arranged to accommodate rocking of the base on the edge relative to an underlying support surface; a member movably connected to a first end of the base, wherein the member and the base cooperate to define an assembly that measures less than six inches long, less than two inches wide, and less than two inches thick, and contact regions are disposed on opposite sides of the base at central locations relative to the assembly to accommodate spinning of the assembly through multiple revolutions relative while the assembly is held between a person's thumb and opposing finger; and an unobstructed hole extending through the base proximate an opposite, second end of the base to accommodate rotation of the assembly about an object inserted into the hole.

The present invention may also be described in terms of methods of amusement involving various uses and/or combinations of uses of the embodiments described above. For example, with the device 300 used as a representative embodiment of the subject invention, FIGS. 30-38 show some, but certainly not all, of the possible activities that may be performed.

Figure 30:
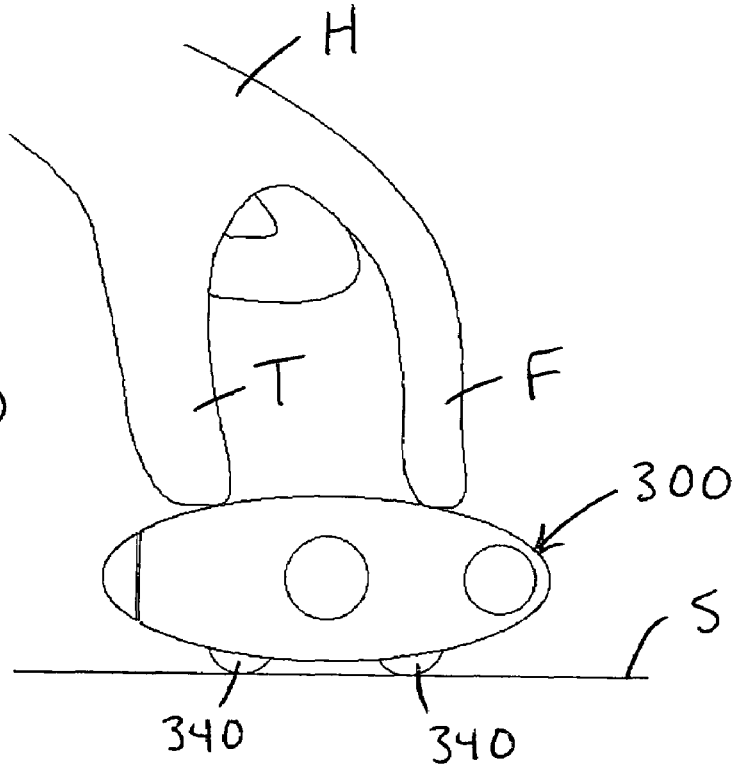
FIG. 30 is a diagrammatic view of the amusement device of FIG. 22 being rolled across an underlying support surface.

FIG. 30 shows the device 300 being rolled across an underlying support surface S (which may be a table top or desk top, for example). In this regard, the device 300 is placed on the support surface S in such a manner that the wheels 340 contact the support surface S. A person's hand H is arranged with a finger F on the opposite, curved side 305, overlying one of the wheels 340, and the opposing thumb T on the opposite, curved side 305, overlying the other wheel 340. Depending on the inclination of the support surface, the hand H either imparts force against the device 300, or simply releases the device 300, in order to roll the device 300 across the support surface S.

Another use involving the wheels 340 is to hold the base in hand, and cause at least one of the wheels 340 to rotate. One way to perform such a method is to hold the base in hand, roll the wheel(s) 340 against a support surface, and then remove the device 300 from the support surface. Another way to perform such a method is to hold the base in hand, and use one or more digits to rotate one or more of the wheels 340. The term "digits" is intended to describe fingers and thumbs without distinction therebetween.

FIG. 31 shows the device 300 being rocked relative to the underlying support surface S. In this regard, the device 300 is placed on the support surface S in such a manner that the curved surface 305 contacts the support surface S. A person's hand H is arranged with the finger F and the opposing thumb T on the opposite side of the base, proximate respective wheels 340. The hand H imparts force against the device 300 in order to rock the device 300 relative to the support surface S.

Another use involving the curved surface 305 is to arrange the device 300 as shown in FIG. 31, and then spin the device 300 on top of the support surface S. The spinning may be accompanied by placing the finger F on the surface directly above the ball 350 and between the wheels 340 in order to steady the device 300, or the device 300 may be allowed to spin freely (like a top).

Figure 32:
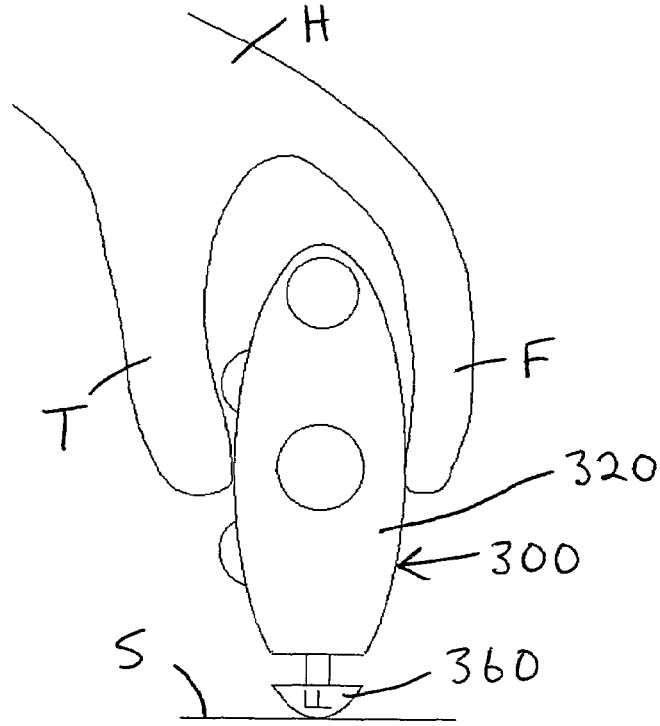
FIG. 32 is a diagrammatic view of the amusement device of FIG. 22 being compressed against an underlying support surface.

FIG. 32 shows the device 300 being bounced relative to the underlying support surface S. In this regard, the device 300 is manipulated to release the plunger 360, and then arranged relative to the support surface S in such a manner that the plunger 360 is immediately above the support surface S. A person's hand H holds the base between the finger F and the opposing thumb T. Depending on the elevation of the device 300 relative to the support surface S, the hand H either imparts downward force against the device 300, or simply releases the device 300, in order to bounce the device 300 on the support surface S.

Another use involving the plunger 360 is to hold the base in hand, and use one or more digits to move the plunger 360 relative to the base. One way to perform such a method of use is to hold the base in hand with the plunger 360 in its latched position, and rotate the plunger 360 to its released position, allowing it to spring outward. Another way to perform such a method of use is to hold the base in hand with the plunger 360 extended, and intermittently push the plunger 360 toward the base.

Figure 33:
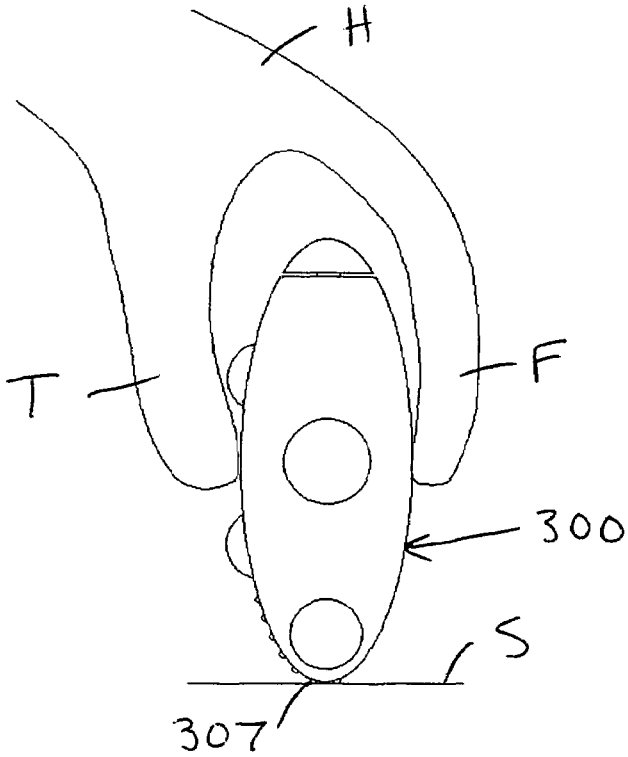
FIG. 33 is a diagrammatic view of the amusement device of FIG. 22 being balanced on end on an underlying support surface.

FIG. 33 shows the device 300 being balanced on end relative to the underlying support surface S. In this regard, the device 300 is arranged with the two ribs 307 nearest the longitudinal axis of the plunger 360 contacting the support surface S. A person's hand H holds the base between the finger F and the opposing thumb T. The two ribs 307 define four planar, non-linear contact points that stabilize the device 300 relative to the support surface S. Those skilled in the art will recognize that at least such contact points are required to achieve stability. Another use involving the ribs 307 is to hold the base in hand, and move one or more digits across the ribs 307 for purposes of tactile stimulation.

Figure 34:
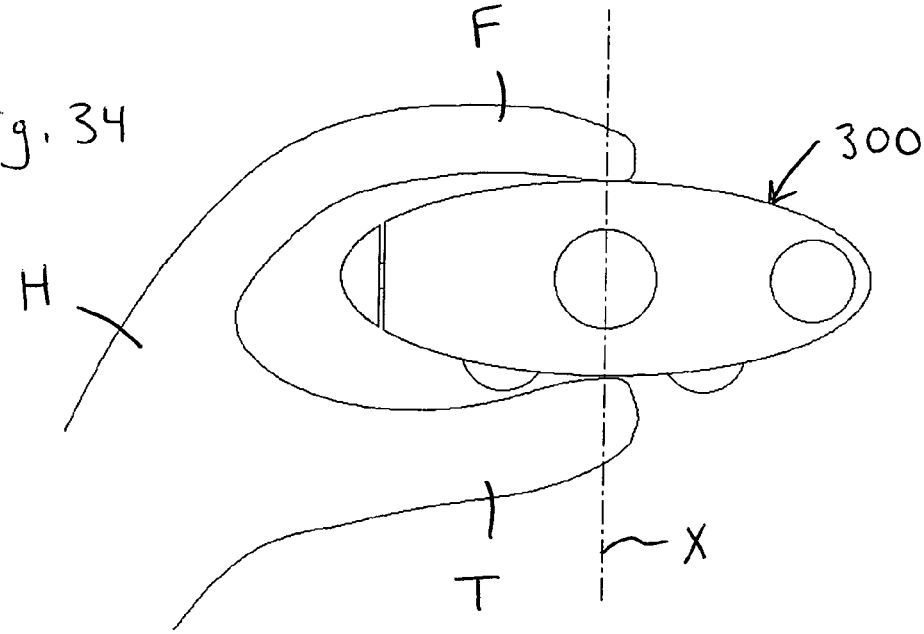
FIG. 34 is a diagrammatic view of the amusement device of FIG. 22 being spun in a first manner relative to a person's hand.

FIG. 34 shows the device 300 being held in hand H and spun about axis X. In this regard, the finger F engages the curved side 305 of the base, and the thumb T engages the opposite side of the base (between the wheels 340). In other words, the thumb T and the finger F engage diametrically opposed bearing surfaces (relative to the ball 350) on the device 300. A force is imparted against either end of the device 300 to spin it about the axis X in such a manner that the opposite ends of the base rotate past a portion of the hand H disposed between the thumb T and the opposing finger F.

Figure 35:
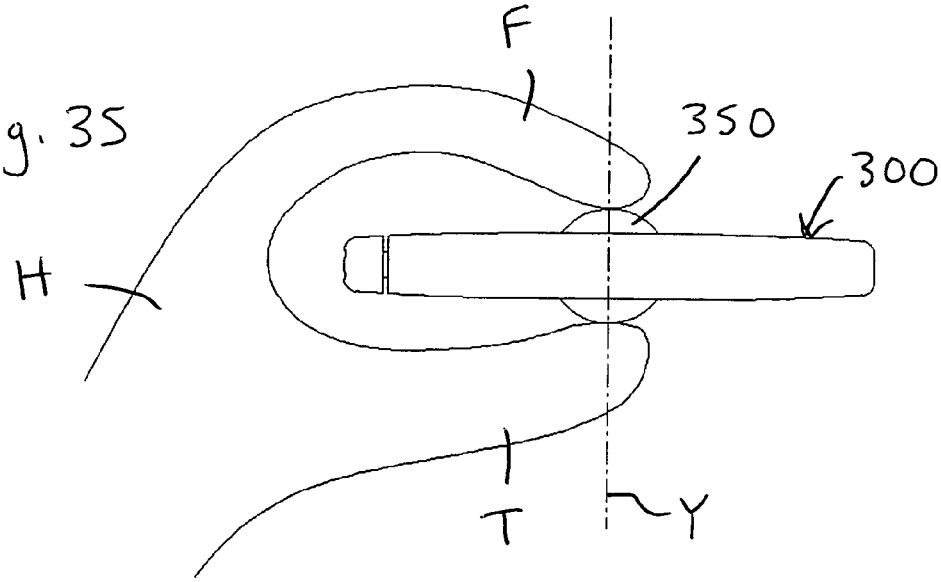
FIG. 35 is a diagrammatic view of the amusement device of FIG. 22 being spun in a second manner relative to a person's hand.

FIG. 35 shows the device 300 being held in hand H, and the elliptical assembly being spun about the ball 350. The finger F and the opposing thumb T engage diametrically opposed portions of the ball 350, which also may be described as diametrically opposed bearing surfaces on the device 300. A force is imparted against either end of the device 300 to spin the elliptical assembly about the axis Y in such a manner that the opposite ends of the base rotate past a portion of the hand H disposed between the thumb T and the opposing finger F.

Figure 36:
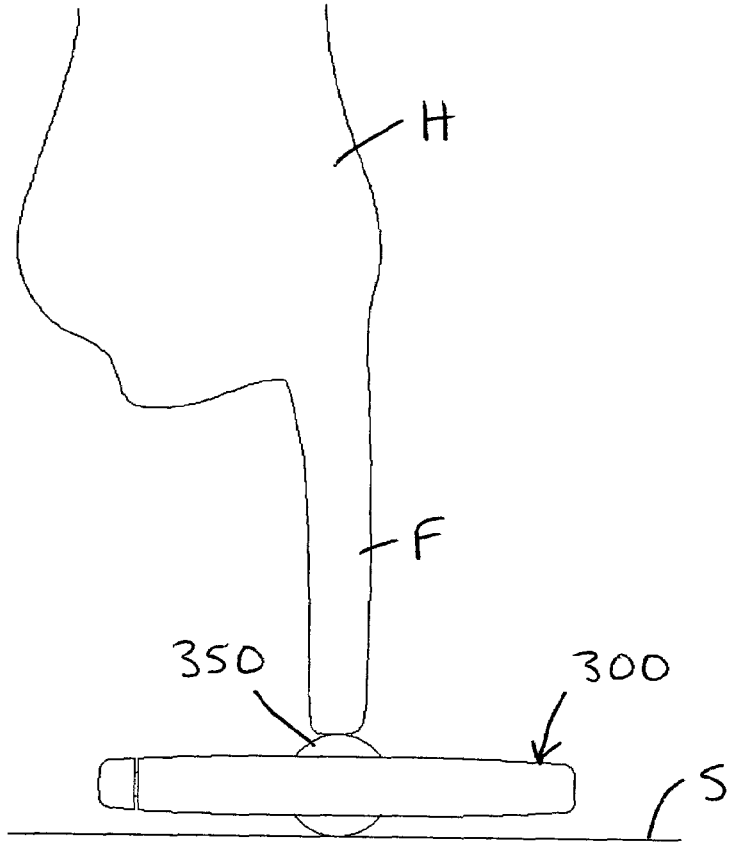
FIG. 36 is a diagrammatic view of the amusement device of FIG. 22 being spun relative to an underlying support surface.

FIG. 36 shows the elliptical assembly being spun about the ball 350 while the ball 350 is held in place against the support surface S. In this regard, the device 300 is placed on the support surface S in such a manner that the ball 350 contacts the support surface S. A person's hand H is arranged with the finger F pressing downward against a diametrically opposed portion of the ball 350. A force is imparted against either end of the device 300 to spin the elliptical assembly about the ball 350. The axis of rotation defined thereby is similar to the axis of rotation designated as Y in FIG. 35.

FIG. 36 shows the device 300 being surfed across the support surface S. The term "surfed" is intended to mean rolled while also being balanced. In this regard, the device 300 is placed on the support surface S in such a manner that the ball 350 contacts the support surface S. A person's hand H is arranged with digits (in this case, the finger F and the opposing thumb) pressing downward against respective bearing surfaces on the base. These surfaces may be described as diametrically opposed relative to the ball 350, and/or as being located between the ball 350 and the hole 301, and between the ball 350 and the plunger 360, respectively. On the base member 310, the embossed ridges 317 and the term WIDGET are disposed on one such surface, and some of the braille letters are disposed on the other such surface. On the base member 320, portions of the pattern 322 are disposed on an alternative pair of such surfaces in similar locations. Forces having a horizontal component are imparted against the base to roll the ball 350 across the support surface S, and/or forces having a vertically downward component are imparted against the base to maintain the entire elliptical assembly in a balanced state above the support surface S.

Figure 37:
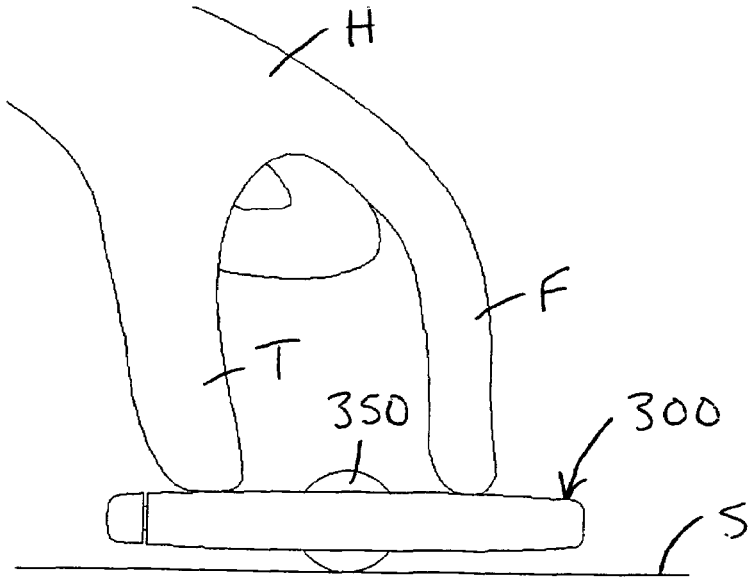
FIG. 37 is a diagrammatic view of the amusement device of FIG. 22 being surfed across an underlying support surface.

The method described with reference to FIG. 37 may alternatively be described in terms of providing a hand-held device 300 with a base having a length that is measured between opposite ends, and a thickness that is measured between opposite top and bottom surfaces, wherein a spherical ball 350 is rotatably mounted inside the base in a manner that projects outward beyond at least one of the top and bottom surfaces; placing the device 300 on an underlying support surface S in such a manner that the ball 350 contacts the support surface S; and using one's digits to apply counterbalancing downward forces to upwardly facing portions of the base on opposite sides of the ball 350 to maintain the entire base above the support surface S while the ball 350 engages the support surface S.

Considering the other uses described above with reference to FIGS. 30-36, additional methods along the lines of the preceding paragraph may be described in conjunction therewith and/or in other separate combinations, including steps such as: (a) rolling the ball 350 across the support surface S while also performing the using step; (b) positioning the ball 350 between one's thumb T and opposing finger F, and spinning the base relative to one's hand H in such a manner that the opposite ends of the base rotate past a portion of one's hand H disposed between the thumb T and the opposing finger F; (c) using one's finger F to hold the ball 350 in place relative to the support surface S, and spinning the base relative to the ball 350 and the support surface S; (d) placing the device 300 on an underlying support surface S in such a manner that the curved surface 305 contacts the support surface S, and rocking the device 300 back and forth relative to the support surface S; (e) placing the device 300 on an underlying support surface S in such a manner that the cylinders or wheels 340 contact the support surface S, and rolling the device 300 across the support surface S; (f) using one's thumb T to engage the side 305 of the base, using one's opposing finger F to engage the opposite side of the base, and spinning the base relative thereto in such a manner that the opposite ends of the base rotate past a portion of one's hand H disposed between the thumb T and the opposing finger F; and/or (g) placing the device 300 on an underlying support surface S in such a manner that the contact points on the ribs 307 contact the support surface S, and balancing the device 300 on end on the support surface S.

Figure 38:
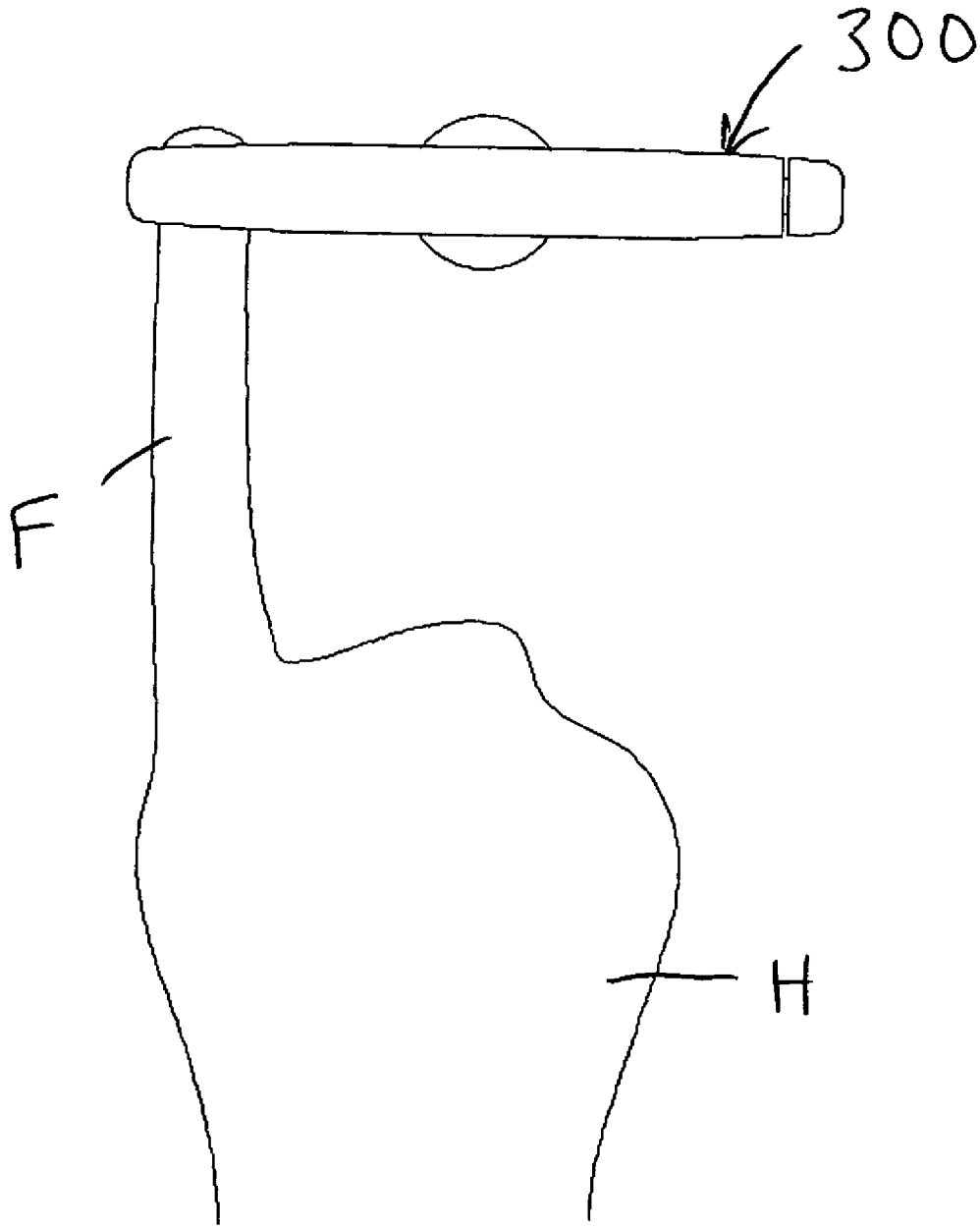
FIG. 38 is a diagrammatic view of the amusement device of FIG. 22 being spun about a person's index finger.

Still another step or use involves inserting one's finger F into the hole 301, and rotating the device 300 about the finger F, which is depicted in FIG. 38. In the alternative, a pencil or pen may be inserted into the hole 301 to rotate the device 300 in either of two manners. One way involves spinning the device 300 in a manner similar to that shown in FIG. 36. The other way involves grabbing opposite ends of the pen or pencil and spinning the device 300 by rotating both ends of the pen or pencil through comparable circles.

The foregoing description and accompanying drawings are intended to be illustrative as opposed to exhaustive, and those skilled in the art will most likely derive other embodiments, applications, and/or methods therefrom. For example, people might be inclined to substitute a new feature for one of the depicted features (e.g. replace the hole 201 with a magnet), or add a feature (e.g add a magnet inside the outer tip of the plunger 160), or alter an existing feature (e.g. magnetize the ball 150). People also might be inclined to arrange various features of the present invention in different ways, and/or to use alternative structures to achieve the same results. In view of the foregoing, the scope of the present invention is to be limited only to the extent of the following claims.

What is claimed is:

1. A method of amusement, comprising the steps of:

providing a hand-held device with a base having a length that is measured between opposite ends, and a thickness that is measured between opposite top and bottom surfaces, and with a hole extending through one of the ends, and with a spherical ball rotatably mounted inside the base in a manner that projects outward beyond at least one of the top and bottom surfaces;

placing the device on an underlying support surface in such a manner that the ball contacts the support surface;

using one's digits to apply counterbalancing downward forces to upwardly facing portions of the base on opposite sides of the ball to maintain the entire base above the support surface while the ball engages the support surface; and alternatively inserting one's finger into the hole, and rotating the device about the finger.

2. The method of claim 1, further comprising the step of rolling the ball across the support surface while also performing the using step.

3. The method of claim 1, wherein the ball projects outward beyond both the top and bottom surfaces, and further comprising the alternative steps of using one's finger to hold the ball in place relative to the support surface; and spinning the base relative to the ball and the support surface.

4. The method of claim 1, wherein the base is provided with a curved surface extending along a side of the base interconnected between the top and bottom surfaces, and further comprising the alternative steps of placing the device on an underlying support surface in such a manner that the curved surface contacts the support surface; and rocking the device back and forth relative to the support surface.

5. The method of claim 4, wherein the base is provided with rotatable cylinders that project outward from an opposite side of the base interconnected between the top and bottom surfaces, and further comprising the alternative steps of placing the device on an underlying support surface in such a manner that the cylinders contact the support surface; and rolling the device across the support surface.

6. The method of claim 5, further comprising the alternative steps of using one's thumb to engage the side of the base; using one's opposing finger to engage the opposite side of the base; and spinning the base relative thereto in such a manner that the opposite ends of the base rotate past a portion of one's hand disposed between the thumb and the opposing finger.

7. The method of claim 1, wherein the base is provided with at least three planar, non-linear contact points at one of the ends, and further comprising the alternative steps of placing the device on an underlying support surface in such a manner that the contact points contact the support surface; and balancing the device on end on the support surface.

8. The method of claim 1, further comprising the alternative steps of holding the base between one's thumb and opposing finger; and spinning the base relative thereto in such a manner that the opposite ends of the base rotate past a portion of one's hand disposed between the thumb and the opposing finger.

9. A method of amusement, comprising the steps of:

providing a hand-held device with a base having a length that is measured between opposite ends, and a thickness that is measured between opposite top and bottom surfaces, and with at least three planar, non-linear contact points at one of the ends, and a spherical ball rotatably mounted inside the base in a manner that projects outward beyond both of the top and bottom surfaces;

positioning diametrically opposed portions of the ball between one's thumb and opposing finger; and spinning the base relative to one's hand in such a manner that the opposite ends of the base rotate past a portion of one's hand disposed between the thumb and the opposing finger; and alternatively placing the device on an underlying support surface in such a manner that the contact points contact the support surface; and balancing the device on end on the support surface.

10. A method of amusement, comprising the steps of:

providing a hand-held device with a base having a length that is measured between opposite ends, a thickness that is measured perpendicular to the length between opposite top and bottom surfaces, and a width that is measured perpendicular to both the length and the width between opposite sides of the base, including at least one side that defines an outwardly convex periphery, and a hole extending through one of the ends, and at least three planar, non-linear contact points at one of the ends, and a member connected to the base in a manner that projects outward beyond at least one of the top and bottom surfaces;

placing the device on an underlying support surface in such a manner that the member contacts the support surface, and using one's digits to apply counterbalancing downward forces to upwardly facing portions of the base on opposite sides of the member to maintain all of the base above the support surface while the member engages the support surface;

alternatively placing the device on the support surface in such a manner that contact points contact the support surface, and balancing the device on end on the support surface;

alternatively inserting one's finger into the hole, and rotating the device about the finger; and alternatively placing the device on the support surface in such a manner that the outwardly convex periphery contacts the support surface, and using one's digits to rock the outwardly convex periphery on the support surface.

11. The method of claim 10, wherein the device is provided with the member connected to the base in a manner that projects outward beyond both of the top and bottom surfaces, and further comprising the step of alternatively placing the device on the support surface in such a manner that a first portion of the member contacts the support surface, and using one's digits to engage a diametrically opposed, second portion of the member and spin the base relative to the support surface.

12. The method of claim 11, further comprising the step of alternatively holding the first portion and the second portion between one's finger and opposing thumb, respectively, and spinning the base through multiple revolutions relative thereto.

13. The method of claim 10, wherein the device is provided with the member rotatably mounted on the base, and the step involving application of counterbalancing downward forces also involves rolling of the member across the support surface.

14. The method of claim 10, further comprising the step of alternatively holding diametrically opposed portions of the base between one's finger and opposing thumb, and spinning the device through multiple revolutions relative thereto.

15. A method of amusement, comprising the steps of:

providing a hand-held device with a base having a length that is measured between opposite ends, and a thickness that is measured perpendicular to the length between opposite top and bottom surfaces, and with a member connected to the base in a manner that projects outward beyond both of the top and bottom surfaces, and with a wheel rotatably connected to the base for rotation about an axis extending parallel to the thickness;

placing the device on an underlying support surface in such a manner that the member contacts the support surface, and using one's digits to apply counterbalancing downward forces to upwardly facing portions of the base on opposite sides of the member to maintain all of the base above the support surface while the member engages the support surface;

alternatively placing the device on the support surface in such a manner that a first portion of the member contacts the support surface, and using one's digits to engage a diametrically opposed, second portion of the member and spin the base relative to the support surface; and alternatively placing the device on the support surface in such a manner that the wheel contacts the support surface, and using one's digits to roll the wheel across the support surface.

16. The method of claim 15, further comprising the step of alternatively holding the first portion and the second portion between one's finger and opposing thumb, respectively, and spinning the base through multiple revolutions relative thereto.

17. The method of claim 15, wherein the device is provided with the member rotatably mounted on the base, and the step involving application of counterbalancing downward forces also involves rolling of the member across the support surface.

18. The method of claim 15, further comprising the step of alternatively holding diametrically opposed portions of the base between one's finger and opposing thumb, and spinning the device through multiple revolutions relative thereto.

19. The method of claim 15, wherein the base is provided with at least three planar, non-linear contact points at one of the ends, and further comprising the alternative steps of placing the device on an underlying support surface in such a manner that the contact points contact the support surface; and balancing the device on end on the support surface.

20. The method of claim 15, wherein the base is provided with a hole through one of the ends, and further comprising the alternative steps of inserting one's finger into the hole; and rotating the device about the finger.

* * * * *